US007905128B2

(12) United States Patent
Matsen et al.

(10) Patent No.: US 7,905,128 B2
(45) Date of Patent: Mar. 15, 2011

(54) FORMING METHOD AND APPARATUS AND AN ASSOCIATED PREFORM HAVING A HYDROSTATIC PRESSING MEDIUM

(75) Inventors: Marc R. Matsen, Seattle, WA (US); Wesley B. Crow, Bellevue, WA (US); Lee C. Firth, Renton, WA (US)

(73) Assignee: The Boeing Company, Chicago, IL (US)

( * ) Notice: Subject to any disclaimer, the term of this patent is extended or adjusted under 35 U.S.C. 154(b) by 189 days.

(21) Appl. No.: 12/179,230

(22) Filed: Jul. 24, 2008

(65) Prior Publication Data

US 2010/0018271 A1 Jan. 28, 2010

(51) Int. Cl.
*B21D 37/16* (2006.01)
*B21D 26/02* (2006.01)

(52) U.S. Cl. ..... 72/60; 72/54; 72/56; 29/421.1; 219/634

(58) Field of Classification Search ..... 72/54, 56, 72/60; 29/421.1; 219/633, 634, 659
See application file for complete search history.

(56) References Cited

U.S. PATENT DOCUMENTS 3,516,274 A 6/1970 Graham et al.
3,661,004 A 5/1972 Lee et al.
5,645,744 A 7/1997 Matsen et al.
5,728,309 A 3/1998 Matsen et al.
5,747,179 A * 5/1998 Matsen et al. ..... 29/421.1
6,528,771 B1 3/2003 Matsen et al.
6,855,917 B2 2/2005 Matsen et al.
6,897,419 B1 5/2005 Brown et al.
7,024,897 B2 * 4/2006 Pfaffmann et al. ..... 72/60

FOREIGN PATENT DOCUMENTS

FR 1 312 726 A 12/1962
FR 2 310 816 A 12/1976
JP 56 126032 A 10/1981

OTHER PUBLICATIONS

PCT/US2009/051562 International Search Report, mailed Sep. 29, 2009.
PCT/US2009/051562 Written Opinion, mailed Sep. 29, 2009.

* cited by examiner

*Primary Examiner* — David B Jones
(74) *Attorney, Agent, or Firm* — Alston & Bird LLP

(57) ABSTRACT

A method and apparatus for forming a workpiece having a desired configuration as well as an associated preform assembly are provided. The forming method and apparatus as well as the preform assembly include a hydrostatic pressing medium, such as a layer of glass, disposed within the die cavity proximate to at least one side of the workpiece. The hydrostatic pressing medium is configured to have a relatively low viscosity at the temperatures at which the workpiece is processed, thereby facilitating the relatively even application of pressure to the workpiece. As such, a workpiece having a complex configuration may be formed utilizing a single acting die.

20 Claims, 5 Drawing Sheets

FORMING METHOD AND APPARATUS AND AN ASSOCIATED PREFORM HAVING A HYDROSTATIC PRESSING MEDIUM

FIELD OF THE INVENTION

Embodiments of the present invention relate generally to methods and apparatus for forming a workpiece having a desired configuration and, more particularly, to methods and apparatus for forming a workpiece which include a hydrostatic pressing medium in order to provide relatively even pressure across the surface of the workpiece, including a workpiece having a complex shape.

BACKGROUND OF THE INVENTION

A variety of techniques are employed to consolidate a workpiece so as to form a part having a desired configuration. For example, vacuum hot pressing or hot isostatic pressing may be employed to consolidate a workpiece. Alternatively, workpieces may be consolidated by the application of pressure concurrent with the inductive heating of the workpiece. In this regard, an apparatus for consolidating a workpiece may include first and second dies which cooperate to define an internal cavity. A susceptor may line the internal cavity and, in turn, define a die cavity for receiving the workpiece. The susceptor is formed of a conductive material, while the first and second dies are formed of a material transparent to electromagnetic energy. In order to heat the susceptor and, in turn, the workpiece, an induction heating coil is positioned proximate the first and second dies for generating electromagnetic energy, such as an oscillating electromagnetic field. Since the first and second dies are transparent to the electromagnetic energy, the electromagnetic energy travels through the dies and interacts with the susceptor, thereby rapidly heating the susceptor. Since the workpiece is in thermal contact with the susceptor, the heating of the susceptor also serves to heat the workpiece.

Susceptors may be referred to as smart susceptors because the material composition of the susceptor is specifically chosen to produce a set temperature point when used in an induction processing system. In this regard, the material composition of the susceptor may be chosen such that the Curie point of the susceptor at which there is a transition between the ferromagnetic and paramagnetic phases of the material forming the susceptor is used to set the equilibrium temperature point to which the susceptor is inductively heated.

In order to permit the formation to occur at lower pressures and temperatures, a forming technique has been developed to take advantage of the unique properties of metallic materials when the crystallographic characteristics of the metallic materials are changing. In this regard, a workpiece, such as a preform, can be placed within a die cavity and pressure applied thereto. An induction heating coil can then be energized so as to generate an oscillating electromagnetic field which heats the susceptor and, in turn, the workpiece to a temperature proximate the phase transformation temperature rangeover which one solid phase of the workpiece changes completely to a second solid phase. The temperature of the workpiece is then repeatedly cycled above and below the phase transformation temperature range in order to consolidate the workpiece.

While this technique is effective for consolidating workpieces, it would be advantageous to form the workpiece to have or at least to closely approximate its final desired shape in order to minimize the work required following consolidation to appropriately shape the workpiece. However, it is frequently desirable for a workpiece to have a complex configuration having portions which extend in different directions. In order to appropriately consolidate the workpiece, it is therefore desirable for the die assembly to apply relatively even pressure across all of the surfaces of the workpiece such that the consolidation process proceeds uniformly. In instances in which the desired configuration of the workpiece is complex, however, the die assembly may require double or triple acting dies, each oriented in a different direction so as to appropriately apply pressure to a respective portion of the workpiece. The use of double or triple acting dies increases the complexity of the die assembly as well as the overall cost of the die assembly. Thus, it would be desirable to provide relatively even pressure to the surfaces of a workpiece, including a complexly configured workpiece, in the manner that would not require multiple die presses, but which could instead be formed with a single acting die.

BRIEF SUMMARY OF THE INVENTION

A method and apparatus for forming a workpiece having a desired configuration as well as an associated preform assembly are provided in accordance with embodiments of the present invention. In this regard, the forming method and apparatus as well as the preform assembly include a hydrostatic pressing medium disposed within the die cavity proximate to at least one side of the workpiece. The hydrostatic pressing medium is configured to be a liquid having a relatively high viscosity at the temperatures at which the workpiece is processed, thereby facilitating the relatively even application of pressure to the workpiece. As such, embodiments of the present invention permit a workpiece having a complex configuration to be formed utilizing a single acting die so as to reduce the complexity and cost of the die assembly relative to other die assemblies that require double or triple acting dies.

An apparatus is provided in accordance with one embodiment of the present invention for forming a workpiece having a desired configuration. The apparatus includes first and second co-operable dies as well as a susceptor formed of a conductive material. The first and second co-operable dies and the susceptor are configured to define a die cavity for receiving the workpiece and defining the desired configuration of the workpiece. The susceptor is in thermal communication with the die cavity and, more particularly, with the workpiece disposed within the die cavity, so as to repeatedly cycle the workpiece between a first temperature above a phase transus temperature of the workpiece and a second temperature below the phase transus temperature of the workpiece.

The apparatus of this embodiment also includes a hydrostatic pressing medium disposed within the die cavity so as to be proximate at least one side of the workpiece. The hydrostatic pressing medium is configured to be a liquid having a viscosity of approximately $10^3$ poise ($10^3$ decipascal-sec) in the cycled temperature range. The hydrostatic pressing medium may be an amorphous material, such as glass. A hydrostatic pressing medium is also generally non-reactive with the workpiece at temperatures between the first and second temperatures. The hydrostatic pressing medium, such as glass, may be configured to encapsulate the workpiece. The hydrostatic pressing medium, such as glass, may also be carried by the workpiece, such as a coating on one or all surfaces of the workpiece.

The apparatus of this embodiment may also include a controller configured to control the cyclic heating and cooling of the workpiece. In this regard, the controller may be configured to determine that the workpiece is at the second temperature below the phase transus temperature of the workpiece by detecting that a cooling rate of the workpiece has returned to a more rapid cooling rate following a decrease in the cooling rate within and/or below the phase transformation temperature range and to then cause the workpiece to be heated in response to the determination that the workpiece is at the second temperature. The controller of this embodiment may also be configured to determine that the workpiece is at the first temperature above the phase transus temperature of the workpiece by detecting that the susceptor has reached the Curie temperature and to then cause a workpiece to be cooled in response to a determination that the workpiece is at the first temperature range. As such, the controller facilitates the repeated cycling of the temperature between the first and second temperatures on either side of the phase transus temperature. In this embodiment, the apparatus may also include a power supply and an induction heating coil that is configured to emit electromagnetic energy to heat the susceptor and, in turn, the workpiece. In this embodiment, the controller is configured to determine that the workpiece is at the first temperature above the phase transus temperature range by detecting a completion of a decrease in the current level provided by the power supply to the induction heating coil.

By providing a hydrostatic pressing medium within the die cavity proximate at least one side of the workpiece, the hydrostatic pressing medium can facilitate the relatively even application of pressure to all surfaces of the workpiece. As such, even in instances in which the desired configuration of the workpiece is complex with portions of the workpiece extending in different directions, the apparatus of one embodiment need only include a single acting die in order to form the workpiece to the desired configuration. As such, the complexity and cost of the die relative to double or triple acting dies may be reduced.

A preform assembly is provided in accordance with another embodiment of the present invention which includes a preform configured to change from a first solid phase to a second solid phase across a phase transformation temperature range and a hydrostatic pressing medium disposed on the least one side of the preform. The hydrostatic pressing medium is configured to be a liquid having a viscosity greater than approximately $10^3$ poise ($10^3$ decipascal-sec) within a range of temperatures which includes the phase transus temperature. The hydrostatic pressing medium may be an amorphous material, such as glass. The hydrostatic pressing medium may also be non-reactive with the preform within the range of temperatures. In one embodiment, the hydrostatic pressing medium, such as glass, encapsulates the preform.

In another embodiment, a method for forming a workpiece having a desired configuration is provided. The method includes positioning the workpiece within a die cavity defined by a die assembly. The die cavity defines the desired configuration of the workpiece. A hydrostatic pressing medium, such as glass, is also disposed within the die cavity so as to be proximate at least one side of the workpiece. The method of this embodiment also repeatedly cycles the workpiece between the first temperature above the phase transus temperature of the workpiece and the second temperature below the phase transus temperature of the workpiece. The method further applies pressure to the workpiece and the hydrostatic pressing medium concurrent with the repeated cycling of the workpiece between the first and second temperatures. As before, the hydrostatic pressing medium remains in a liquid phase with a viscosity greater than approximately $10^3$ poise ($10^3$ decipascal-sec) while repeatedly cycling the workpiece between the first and second temperatures.

In repeatedly cycling a workpiece between the first and second temperatures, the method of one embodiment may determine that the workpiece is at the second temperature below the phase transus temperature of the workpiece by detecting that a cooling rate of the workpiece has returned a more rapid cooling rate following a decrease in the cooling rate within and/or above the phase transformation temperature range and may then heat the workpiece in response to the determination that the workpiece is at the second temperature. The method of this embodiment may also determine that the workpiece is at the first temperature above the phase transus temperature of the workpiece by detecting that the susceptor has reached the Curie temperature and may then cause the workpiece to be cooled in response to a determination that the workpiece is at the first temperature. In instances in which a power supply and an induction heating coil configured to emit electromagnetic energy to heat the workpiece are also provided, the determination that the workpiece is at the first temperature above the phase transus temperature may include the detection of a completion of a decrease in a current level provided by the power supply to the induction heating coil.

As noted above, the hydrostatic pressing medium facilitates the relatively even application of pressure to the workpiece. As such, workpieces having even a complex configuration may be formed with a single acting die, thereby reducing the complexity and cost of the die assembly relative to die assemblies including double or triple acting dies.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
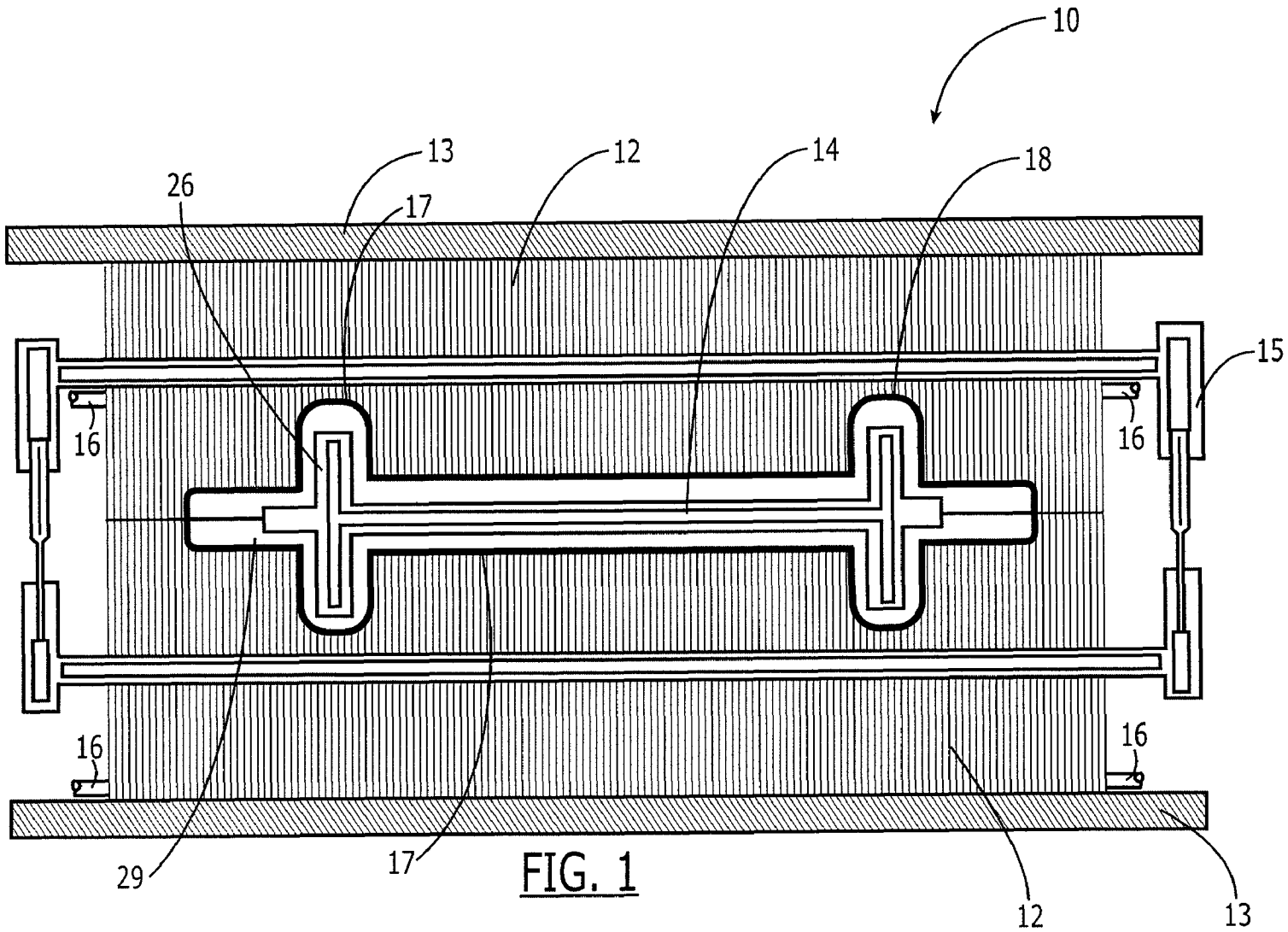
FIG. 1 is a cross-sectional view of the apparatus for forming a workpiece in accordance with one embodiment of the present invention.
Figure 2:
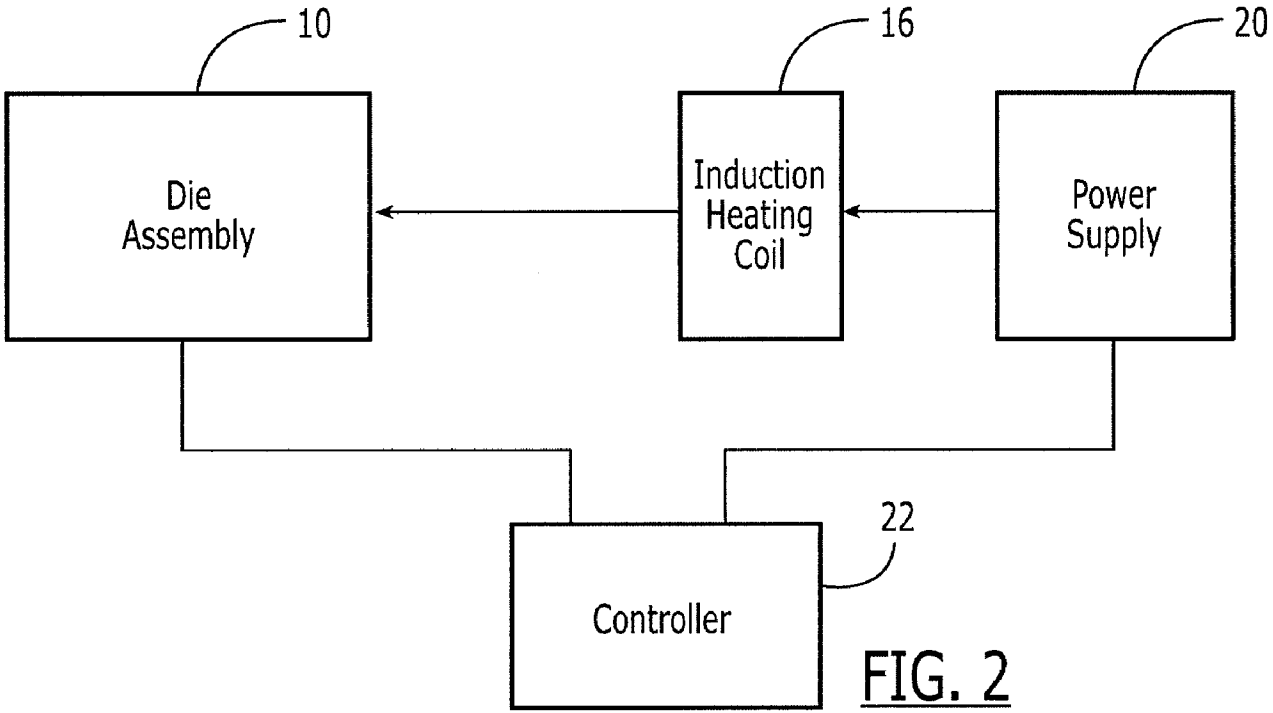
FIG. 2 is a block diagram of an apparatus for forming a workpiece in accordance with one embodiment of the present invention.

Referring now to FIGS. 1 and 2, an apparatus 10 for forming a workpiece is depicted. The apparatus includes a die assembly including two or more dies 12, such as the first and second co-operable dies as shown in FIG. 1. The dies are typically formed of a strong and rigid material relative to the workpiece 14 and are also formed of a material having a melting point well above the processing temperature of the workpiece. Additionally, the dies can be formed of a material characterized by a low thermal expansion, high thermal insulation, and a low electromagnetic absorption. For example, each of the dies may include multiple stacked metal sheets, such as stainless steel sheets or sheets formed of an Inconel® 625 alloy, which are trimmed to the appropriate dimensions for the induction coils (described below). The stacked metal sheets may be oriented in generally perpendicular relationship with respect to the respective contoured die surfaces. Each metal sheet may have a thickness of from about 1/16" to about 1/4", for example and preferably about 0.200". An air gap may be provided between adjacent stacked metal sheets to facilitate cooling of the dies, such as a gap of about 0.15". The stacked metal sheets may be attached to each other using clamps (not shown), fasteners (not shown) and/or other suitable technique known to those skilled in the art. The stacked metal sheets may be selected based on their electrical and thermal properties and may be transparent to the magnetic field. An electrically insulating coating (not shown) may optionally be provided on each side of each stacked sheet to prevent flow of electrical current between the stacked metal sheets. The insulating coating may be a material such as a ceramic material, for example. Multiple thermal expansion slots may be provided in the dies to facilitate thermal expansion and contraction of the stacked tooling apparatus 10.

The die assembly can also include two or more strongbacks 13 to which the dies 12 are mounted. As shown in FIG. 1, for example, the first and second dies may be mounted to and supported by first and second strongbacks, respectively. A strongback is a stiff plate, such as a metal plate, that acts as a mechanical constraint to keep the dies together and to maintain the dimensional accuracy of the dies. The die assembly also generally includes an actuator, shown generically as 15 in FIG. 1, for controllably moving the dies toward and away from one another, such as by moving the dies toward one another so as to apply a predetermined amount of pressure to the workpiece 14. Various types of actuators may be employed including, for example, hydraulic, pneumatic or electric rams.

As shown in cross-section in FIG. 1, the dies 12 define an internal cavity. In embodiments in which the workpiece 14 is formed by hot pressing operations, such as vacuum hot pressing or hot isostatic pressing, the internal cavity defined by the dies may serve as the die cavity in which the workpiece is disposed. In the embodiment depicted in FIG. 2, however, the apparatus 10 for forming a workpiece includes one or more induction coils 16 that extend through the dies to facilitate selective heating of the dies. A thermal control system may be connected to the induction coils. A susceptor may be thermally coupled to the induction coils of each die. Each susceptor may be a thermally-conductive material such as a ferromagnetic material, cobalt or nickel, for example. Each susceptor may generally conform to the first contoured die surface of the respective die.

Electrically and thermally insulative coatings 17, i.e., die liners, may be provided on the contoured die surfaces of the dies 12. The electrically and thermally insulative coating may be, for example, alumina or silicon carbide and, more particularly, a SiC matrix with SiC fibers. The susceptors may, in turn, be provided on the electrically and thermally insulative coatings of the respective dies.

A cooling system may be provided in each die. The cooling system may include, for example, coolant conduits which have a selected distribution throughout each die. The coolant conduit may be adapted to discharge a cooling medium into the respective die. The cooling medium may be a liquid, gas or gas/liquid mixture which may be applied as a mist or aerosol, for example.

The susceptor 18 is responsive to electromagnetic energy, such as an oscillating electromagnetic field, generated by the induction heating coils 16. In response to the electromagnetic energy generated by the induction heating coils, the susceptor is heated which, in turn, heats the workpiece 14. In contrast to techniques in which the dies are heated and cooled, induction heating techniques can more quickly heat and cool a workpiece in a controlled fashion as a result of the relatively rapid heating and cooling of the susceptor. For example, some induction heating techniques can heat and cool a workpiece about two orders of magnitude more quickly than conventional autoclave or hot isostatic pressing (HIP) processes. In one embodiment, the susceptor is formed of ferromagnetic materials including a combination of iron, nickel, chromium and/or cobalt with the particular material composition chosen to produce a set temperature point to which the susceptor is heated in response to the electromagnetic energy generated by an induction heating coil. In this regard, the susceptor may be constructed such that the Curie point of the susceptor at which there is a transition between the ferromagnetic and paramagnetic phases of the material defines the set temperature point to which the susceptor is inductively heated. Moreover, the susceptor may be constructed such that the Curie point is greater, albeit typically only slightly greater, than the phase transformation temperature of the workpiece.

Figure 3:
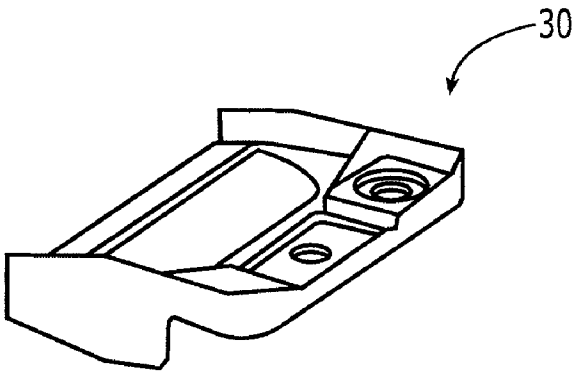
FIG. 3 is a perspective view of a part which could be formed in accordance with embodiments of the present invention.

As also shown in FIG. 1, a workpiece 14 is disposed within the die cavity. As described below, the method and apparatus 10 of embodiments of the present invention can form workpieces to have a desired complex configuration in which different portions of the workpiece extend in different directions. However, the method and apparatus of embodiments of the present invention can form workpieces having any desired configuration. As such, the method and apparatus of embodiments of the present invention can form workpieces for a wide variety of applications. In this regard, the method and apparatus of embodiments of the present invention can form workpieces for aerospace, automotive, marine, construction, structural and many other applications. As shown in FIG. 3, for example, a connector plate 30 for connecting a floor beam to the fuselage of an aircraft is formed and depicts one example of a complexly configured workpiece that can be formed in accordance with embodiments of the method and apparatus of the present invention.

The workpiece 14 may also be formed of a variety of materials, but is typically formed of a metal alloy that experiences a phase change between two solid phases at an elevated temperature and pressure, that is, at a temperature and pressure greater than ambient temperature and pressure and, typically, much greater than ambient temperature and pressure. For example, the metal alloy forming the workpiece may be a steel or iron alloy. In one embodiment, however, the workpiece is formed of a titanium alloy, such as Ti-6-4 formed of 6% (weight percent) aluminum, 4% (weight percent) vanadium and 90% (weight percent) titanium. Under equilibrium conditions at room temperature, Ti -6-4 contains two solid phases, that is, a hexagonal close-packed phase, termed the alpha phase, which is more stable at lower temperatures and a body-centered cubic phase, termed the beta phase, which is more stable at higher temperatures. At equilibrium conditions at room temperature, Ti-6-4 is a mixture of the beta phase and the alpha phase with the relative amount of each phase being determined by thermodynamics. As the temperature is increased, the alpha phase transforms to the beta phase over a phase transformation temperature range until the alloy becomes entirely formed of the beta phase at temperatures above the beta transus temperature. By way of example, for Ti-6-4, the beta transus temperature is approximately 1000° C. Similarly, the Ti -6-4 will gradually change from the beta phase to the alpha phase as the temperature is decreased below the beta transus temperature over a phase transformation range. While for titanium alloys, the transformation from the hexagonal close packed phase to the body centered cubic phase occurs over a temperature range, for pure titanium, the transformation occurs at a single temperature value, about 880° C. Reference herein to a phase transformation temperature range includes both a range including a plurality of temperatures as well as a single temperature value. Additionally, the beta transus temperature varies depending upon the exact composition of the alloys.

Accompanying the microstructural rearrangement of atoms during the transformation from the alpha phase to the beta phase are changes in the lattice parameters for each of the phases due to changes in the temperature. These changes in the lattice parameters result in a positive volume change. This microstructural change in volume results in an instantaneous increase in strain rate upon heating of the alloy which, in turn, enables a given quantity of deformation to be produced in response to lower applied pressures or, stated differently, more deformation to be produced at a given pressure. By taking advantage of the phase transformation superplasticity of the workpiece at temperatures within or proximate the phase transformation temperature range, the workpiece 14 may be consolidated at lower pressures and temperatures than conventional techniques.

As also shown FIG. 1, the method and apparatus 10 for forming a workpiece in accordance with embodiments of the present invention also employ a hydrostatic pressing medium 26 disposed within the die cavity so as to be proximate at least one side of the workpiece 14. While the hydrostatic pressing medium need only be proximate one side of the workpiece, the hydrostatic pressing medium may surround or encapsulate the workpiece so as to be proximate each size of the workpiece, as in the illustrated embodiment. While the hydrostatic pressing medium may be disposed within the die cavity prior to insertion of the workpiece so as to be distinct from the workpiece, the hydrostatic pressing medium may be coated or otherwise disposed upon the workpiece prior to the insertion of the workpiece into the die cavity such that the workpiece carries the hydrostatic pressing medium.

The hydrostatic pressing medium 26 is configured to be a liquid having a relatively high viscosity at the processing pressure and temperatures at which the method and apparatus 10 of embodiments of the present invention consolidate the workpiece 14. In this regard, the viscosity of the liquid may be at or close to the working point within the phase transformation temperature range. For example, the viscosity may range from ~$10^3$ poise to ~$10^6$ poise for temperatures within the phase transformation temperature range. Additionally, the liquid generally has a low heat capacity, is transparent to radiant energy, is electrically nonconductive and has a relatively high thermal conductivity. In this regard, the hydrostatic pressing medium may be an amorphous material, such as glass. Additionally, the hydrostatic pressing medium is advantageously non-reactive with the workpiece at the elevated temperatures at which the workpiece will be processed and consolidated.

In one embodiment, the hydrostatic pressing medium 26 may be formed of two layers of glass—a first layer proximate the preform and a second layer on the opposite side of the first layer from the preform such that the second layer is spaced from the preform by the first layer. In this embodiment, the first layer is typically stiffer than the second layer, thereby reducing the infiltration of the glass into voids in the workpiece 14.

Figure 4A:
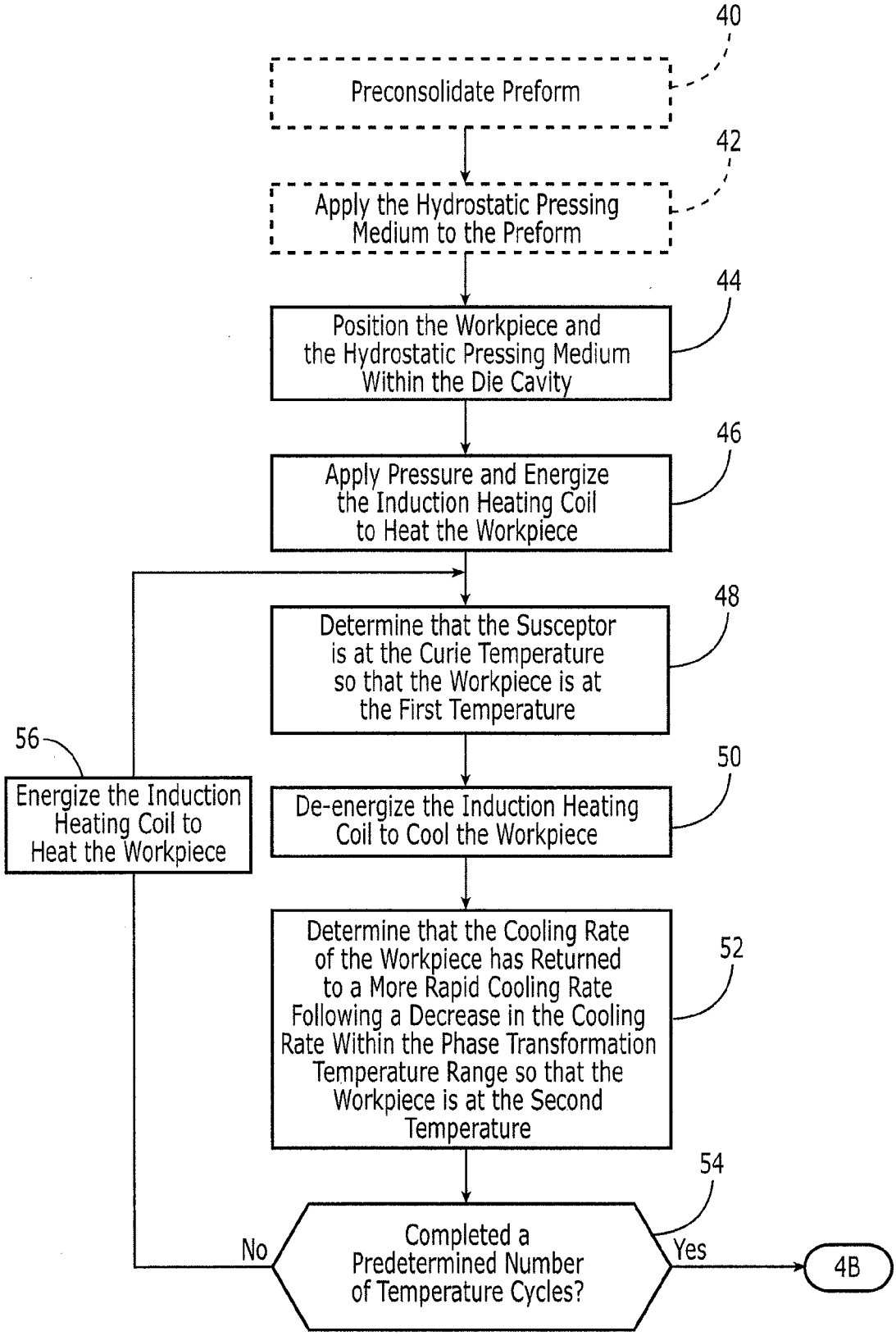
FIGS. 4A and 4B are flowcharts illustrating the operations performed in accordance with one embodiment of the present invention.
Figure 4B:
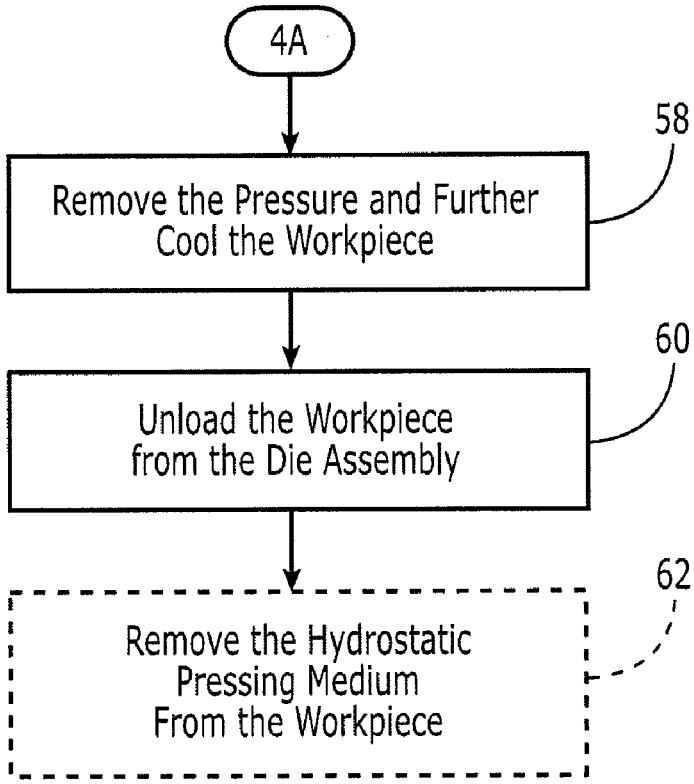

With reference now to FIGS. 4*a* and 4*b*, the operations performed in accordance with a method of forming a workpiece 14 having a desired configuration in accordance with one embodiment of the present invention are depicted. With reference to block 44 of FIG. 4*a*, a workpiece is positioned within the die cavity defined by a die assembly including, for example, the first and second co-operable dies 12. As described above, the die cavity defines the desired configuration of the workpiece. In one embodiment that is also depicted in FIGS. 4*a* and 4*b* in the boxes that are dashed to illustrate the optional nature of the respective operations, a preform of the workpiece may be initially formed. See block 40. The preform may have a shape that approximates the desired configuration of the workpiece even though the preform has not been fully consolidated. In one embodiment, the preform is formed by placing the material from which the workpiece will be formed in a die and then pressing the material in a relatively cold state, such as at room temperature. This die also defines a die cavity in which the material is disposed and which has a shape which approximates the desired configuration of the resulting workpiece.

In one embodiment, the preform is formed from powder which may be mixed and blended to define the desired alloy, such as Ti-6-4. By thereafter pressing the powder within the die, a preform, indeed a near net preform in one embodiment, may be produced in which the powder is preconsolidated to have a shape which approximates the desired configuration of the resulting workpiece 14. Following the preconsolidation of the preform, a layer of the hydrostatic pressing medium 26, such as glass, may be applied to at least one side or, in one embodiment, all surfaces of the preform. See block 42. In embodiments in which the hydrostatic pressing medium is glass, the glass may be applied to the preform by being spun on. Thereafter, the preform having the hydrostatic pressing medium applied thereto may be loaded into the die cavity as described above.

Figure 5:
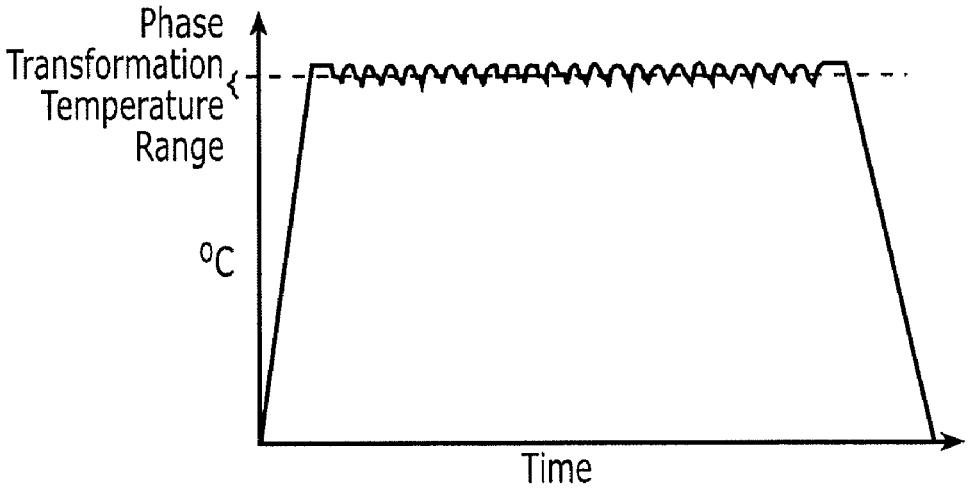
FIG. 5 is a graph representing the cyclical temperature fluctuation across the phase transformation temperature range of a workpiece.

Once the workpiece 14 including the hydrostatic pressing medium 26 has been loaded into the die cavity, the dies 12 are moved toward one another and a predetermined amount of pressure, such as between about 1.5 KSI and 2.5 KSI for Ti-6-4 powder alloys, is applied to the workpiece. See block 46. In this regard, embodiments of the present invention may operate at lower pressures, such as pressures that are an order of magnitude lower, than conventional autoclave and HIP processes. Concurrent with the application of pressure, the workpiece is repeatedly cycled between a first temperature above the beta transus temperature of the workpiece and a second temperature below the beta transus temperature of the workpiece. In this regard, FIG. 5 depicts the phase transformation temperature range of the workpiece across which the workpiece transitions between the alpha and beta phases. As shown graphically in FIG. 5, the temperature of the workpiece is increased relatively rapidly to the first temperature above the beta transus temperature and is then repeatedly cycled between the first and second temperatures prior to the completion of the consolidation process in which the temperature of the workpiece is relatively rapidly decreased to room temperature. While the temperature of the workpiece can be repeatedly cycled any number of times between the first and second temperatures, the method of one embodiment repeatedly cycles a workpiece formed of Ti-6-4 powder alloys between the first and second temperatures for about 90 minutes to about 150 minutes with each heating and cooling cycle requiring about 3 minutes to about 5 minutes. The time required for each cycle and, in turn, the overall time required to process a workpiece may vary in accordance with a number of factors, including the material forming the workpiece. As such, each heating and cooling cycle may be longer than 3-5 minutes and, in one embodiment, each heating and cooling cycle may require about 15 minutes to about 20 minutes.

The first and second temperatures can be selected to be any temperature above and below, respectively, the beta transus temperature. In order to increase the efficiency with which the workpiece 14 is formed in accordance with embodiments of the present invention, the first and second temperatures are typically selected to be only slightly above and below, respectively, the beta transus temperature. As noted above, the phase transformation temperature range will depend upon the precise material composition of the workpiece such that even for a particular type of alloy, the phase transformation temperature range may vary from one workpiece to another since the precise material composition may similarly vary. As such, while the first and second temperatures for a workpiece formed of Ti-6-4 having a beta transus temperature of approximately 1000° C. could be about 1010° C. and 890° C., respectively, the actual phase transformation temperature range of Ti-6-4 may vary somewhat depending upon the exact material composition of the workpiece.

As such, in one embodiment, the first and second temperatures are defined by the actual processing characteristics associated with the workpiece 14. As shown in the upper portion of FIG. 6, for example, the cooling of the workpiece from the first temperature to the second temperature generally follows the stairstep-like pattern. In this regard, the cooling rate of the workpiece is generally relatively rapid and constant from the first temperature to the upper bound of the phase transformation temperature range, i.e., the beta transus temperature, as shown at 70. Within the phase transformation temperature range, the cooling rate slows significantly as shown at 72, prior to again resuming the same relatively rapid cooling rate as shown at 74 once the phase transformation is essentially complete. As such, the apparatus 10 of one embodiment of the present invention may include a controller 22 configured to detect that the cooling rate of the workpiece has returned to a more rapid cooling rate following a decrease in the cooling rate within the phase transformation temperature range. See block 52. In this regard, thermocouples may be employed to monitor the temperature of the workpiece and to provide an indication of the temperature to the controller for determination of the cooling rate. As such, once the controller detects that the cooling rate of the workpiece has returned to the more rapid cooling rate following the decrease in the cooling rate within the phase transformation temperature range, the controller will determine that the workpiece is at the second temperature below the phase transformation temperature range of the workpiece and, in turn, provide a command to cause the workpiece to again be heated. See block 56.

Figure 6:
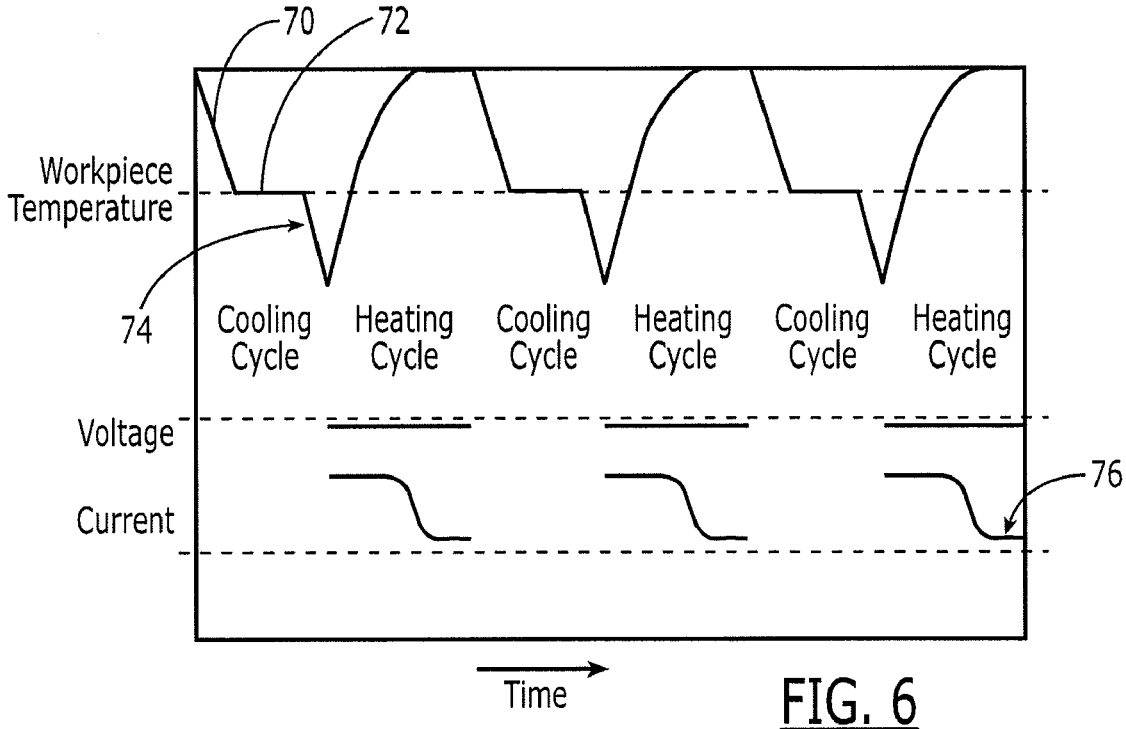
FIG. 6 is a graphical representation of the temperature of a workpiece in comparison to the voltage level and current level of a power supply associated with an induction heating coil in accordance with one embodiment of the present invention.

As described above, the method and apparatus 10 of embodiments of the present invention can heat the workpiece 14 in various manners. In the illustrated embodiment, however, induction heating techniques are employed in which a thermal control system drives an induction heating coils 16 to emit electromagnetic energy, such as an oscillating electromagnetic field, which heats the susceptor 18 which, in turn, heats the workpiece. As such, the commands from the controller 22 of this embodiment to cause the workpiece to be heated actually command the thermal control system to drive the induction heating coils to emit electromagnetic energy. In one embodiment, during the heating cycles, the thermal control system will maintain a constant voltage level and will provide a current to the induction heating coils sufficient to maintain the constant voltage level. As shown in FIG. 6, the current provided by the thermal control system to the induction heating coils in order to maintain the predefined voltage level generally decreases from a first higher current level to a second lower current level 76 as the load created by the susceptor changes due to a change in the susceptor from the ferromagnetic phase to the paramagnetic phase upon the susceptor having reached the Curie point temperature. Since the susceptor is designed such that its Curie point temperature is above the beta transus temperature of the workpiece, the recognition that the susceptor is at the Curie point temperature as a result of the decrease of the current provided by the power supply to the induction heating coils in order to maintain the constant voltage level is also determinative of the workpiece being at the first temperature above the beta transus temperature. As such, the controller is also configured to detect that the susceptor has reached the Curie temperature, such as by detecting a completion of the decrease in the current level provided by the power supply to the induction heating coil. See block 48. Thus, the controller of this embodiment advantageously receives signals indicative of the current provided by the power supply to the induction heating coil and can detect when the current falls below a predefined level or, in one embodiment, when the decrease in the current level has been completed, thereby indicating that the susceptor has reached the Curie temperature. By detecting that the susceptor has reached the Curie temperature, the controller is configured to also determine that the workpiece is at the first temperature above the beta transus temperature and to then issue commands which cause the workpiece to be cooled. In this regard, the controller can issue commands to the power supply terminating the current supply to the induction heating coils which, in turn, terminates the generation of the electromagnetic energy which heated the susceptor and, in turn, the workpiece. See block 50.

By repeating the cooling and heating cycles, such as shown in block 54 of FIG. 4A and in FIGS. 5 and 6 for a predetermined number of cycles, the workpiece may be consolidated in an efficient manner and at relatively lower temperatures and pressures than those required by conventional forming techniques. By consolidating the workpiece at temperatures within and proximate the beta transus temperature, excessive transformation and interaction of phases in the growth of grains in the consolidated workpiece can be controlled. As such, a wide variety of possible material compositions and forms can be fabricated that can be utilized to tailor physical mechanical behavior of the resulting workpiece. For example, at temperatures below 1,000° C., a number of metals and ceramic intermetallic compounds, such as oxides, nitrides, carbides, borides, etc. are stable in titanium and could be incorporated into a variety of titanium alloy compositions in the form of particles, fibers, whiskers, etc. to enhance or otherwise tailor the mechanical, electrical and/or thermal performance of the resulting consolidated workpiece.

Once the repeated cycling of the workpiece 14 between the first and second temperatures has been completed, the temperature of the workpiece may be decreased, such as by no longer generating electromagnetic energy with the induction heating coils 16. Similarly, the pressure applied by the die assembly can be removed and the dies 12 may be opened such that a consolidated workpiece may be removed from assembly. See blocks 58 and 60. In embodiments in which the hydrostatic pressing medium 26, such as glass, is coated on the workpiece, the workpiece may then be processed, such as by a chemical or mechanical process, to remove the hydrostatic pressing medium, such as a glass layer. See block 62. The workpiece can then be machined, if necessary, to have the desired final configuration.

As noted above, the pressure applied by the dies 12 and at temperatures at and between the first and second temperatures, the hydrostatic pressing medium 26 is configured to be a liquid having a relatively high viscosity, such as a viscosity greater than $10^3$. As such, the pressure applied to the workpiece 14 during the thermal processing of the workpiece will be spread relatively evenly across the surface of the workpiece as a result of the hydrostatic properties of the hydrostatic pressing medium. By enabling relatively even load distribution on the workpiece, the hydrostatic pressing medium permits workpieces having a complex configuration, such as workpieces having portions which extend in different directions to be formed with a single acting die, that is, a die assembly that applies pressure in one direction, such as the vertical direction in the embodiment of FIG. 1. As such, workpieces having a complex configuration can be fabricated without requiring the complexity and expense of a double or triple acting die. Moreover, by providing relatively even load distribution as a result of the hydrostatic properties of the hydrostatic pressing medium, the resulting consolidation of the workpiece can be performed in a uniform manner such that the resulting workpiece is relatively uniformly consolidated so as to enjoy the desired material properties.

Many modifications and other embodiments of the inventions set forth herein will come to mind to one skilled in the art to which these inventions pertain having the benefit of the teachings presented in the foregoing descriptions and the associated drawings. For example, several exemplary processing parameters are described above in conjunction with the processing of Ti-6-4 powder alloys with other processing parameters being appropriate for workpieces formed of other materials. Additionally, while embodiments of the present invention have been described in conjunction with temperature cycling sufficient to repeatedly cause a phase change in the workpiece, other embodiments of the present invention may form a workpiece based, not upon the repeated phase change of the workpiece, but the internal stress created by the differences in thermal expansion exhibited by two materials that combine to form the workpiece in response to the thermal cycling. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for forming a workpiece having a desired configuration, the apparatus comprising:

first and second co-operable dies;

a susceptor comprised of a conductive material, wherein the first and second co-operable dies and the susceptor are configured to define a die cavity for receiving the workpiece, wherein the die cavity defines the desired configuration of the workpiece, and wherein the susceptor is in thermal communication with the die cavity to repeatedly cycle the workpiece between a first temperature above a beta transus temperature of the workpiece and a second temperature below the beta transus temperature of the workpiece; and a hydrostatic pressing medium disposed within the die cavity so as to be proximate at least one side of the workpiece, the hydrostatic pressing medium configured to be a liquid having a viscosity greater than $10^3$ poise at temperatures between the first and second temperatures.

2. An apparatus according to claim 1 wherein the hydrostatic pressing medium comprises an amorphous material.

3. An apparatus according to claim 2 wherein the hydrostatic pressing medium comprises glass.

4. An apparatus according to claim 3 wherein the glass is configured to encapsulate the workpiece.

5. An apparatus according to claim 3 wherein the glass is carried by the workpiece.

6. An apparatus according to claim 1 wherein the hydrostatic pressing medium is non-reactive with the workpiece at temperatures between the first and second temperatures.

7. An apparatus according to claim 1 wherein the desired configuration of the workpiece is complex with portions of the workpiece extending in different directions, and wherein the apparatus further comprises a single acting die which includes the first and second co-operable dies.

8. An apparatus according to claim 1 further comprising a controller configured to:

determine that the workpiece is at the second temperature below the beta transus temperature of the workpiece by detecting that a cooling rate of the workpiece has returned to a more rapid cooling rate following a decrease in the cooling rate within a phase transformation temperature range;

cause the workpiece to be heated in response to a determination that the workpiece is at the second temperature;

determine that the workpiece is at the first temperature above the beta transus temperature of the workpiece by detecting that the susceptor has reached a Curie temperature; and cause the workpiece to be cooled in response to a determination that the workpiece is at the first temperature.

9. An apparatus according to claim 8 further comprising a power supply and an induction heating coil responsive to the power supply and configured to emit electromagnetic energy to heat the susceptor, wherein the controller is configured to determine that the workpiece is at the first temperature above the beta transus temperature by detecting a completion of a decrease in a current level provided by the power supply to the induction heating coil.

10. A preform assembly comprising:

a preform configured to change from a first solid phase at a first temperature below a transus temperature to a second solid phase at a second temperature above the transus temperature; and a hydrostatic pressing medium disposed upon at least one side of the preform, the hydrostatic pressing medium configured to be a liquid having a viscosity greater than $10^3$ poise within a phase transformation temperature range between the first and second temperatures.

11. A preform assembly according to claim 10 wherein the hydrostatic pressing medium comprises an amorphous material.

12. A preform assembly according to claim 11 wherein the hydrostatic pressing medium comprises glass.

13. A preform assembly according to claim 12 wherein the glass is configured to encapsulate the preform.

14. A perform assembly according to claim 10 wherein the hydrostatic pressing medium is non-reactive with the preform within the range of temperatures.

15. A method for forming a workpiece having a desired configuration, the method comprising:

positioning a workpiece within a die cavity defined by a die assembly, wherein the die cavity defines the desired configuration of the workpiece, and wherein a hydrostatic pressing medium is also disposed within the die cavity so as to be proximate at least one side of the workpiece;

repeatedly cycling the workpiece between a first temperature above a beta transus temperature of the workpiece and a second temperature below the beta transus temperature of the workpiece; and applying pressure to the workpiece and the hydrostatic pressing medium concurrent with repeatedly cycling the workpiece between the first and second temperatures, wherein the hydrostatic pressing medium remains in a liquid phase with a viscosity greater than $10^3$ poise while repeatedly cycling the workpiece between the first and second temperatures.

16. A method according to claim 15 wherein the hydrostatic pressing medium comprises glass.

17. A method according to claim 16 wherein the glass is configured to encapsulate the workpiece.

18. A method according to claim 16 wherein the glass is carried by the workpiece.

19. A method according to claim 15 wherein repeatedly cycling the workpiece between the first and second temperatures comprises:

determining that the workpiece is at the second temperature below the beta transus temperature of the workpiece by detecting that a cooling rate of the workpiece has returned to a more rapid cooling rate following a decrease in the cooling rate within a phase transformation temperature range;

heating the workpiece in response to a determination that the workpiece is at the second temperature;

determining that the workpiece is at the first temperature above the beta transus temperature of the workpiece by detecting that the susceptor has reached a Curie temperature; and causing the workpiece to be cooled in response to a determination that the workpiece is at the first temperature.

20. A method according to claim 19 further comprising providing a power supply and an induction heating coil responsive to the power supply and configured to emit electromagnetic energy to heat the workpiece, wherein determining that the workpiece is at the first temperature above the beta transus temperature comprises detecting a completion of a decrease in a current level provided by the power supply to the induction heating coil.

* * * * *